US005669734A

United States Patent [19]

Becnel, Jr. et al.

[11] Patent Number: 5,669,734

[45] Date of Patent: Sep. 23, 1997

[54] PROCESS FOR MAKING UNDERGROUND STORAGE CAVERNS

[75] Inventors: Lawrence F. Becnel, Jr., Sugarland; Frank V. Whelply; William H. Barlow, both of Houston, all of Tex.

[73] Assignee: Texas Brine Corporation, Houston, Tex.

[21] Appl. No.: 563,915

[22] Filed: Nov. 29, 1995

[51] Int. Cl.[6] ..... B65G 5/00; F21F 17/16

[52] U.S. Cl. ..... 405/58; 405/55; 405/56; 299/5; 299/3

[58] Field of Search ..... 405/53, 55, 56–58; 299/3, 4, 5, 6

[56] References Cited

U.S. PATENT DOCUMENTS

| | | | |
|---|---|---|---|
| 874,906 | 12/1907 | Frasch . | |
| 874,907 | 12/1907 | Frasch . | |
| 1,923,896 | 8/1933 | Trump . | |
| 2,590,066 | 3/1952 | Patlinson . | |
| 2,869,328 | 1/1959 | Gibson et al. . | |
| 3,083,537 | 4/1963 | Dougherty | 405/56 |
| 3,084,515 | 4/1963 | Dougherty . | |
| 3,277,654 | 10/1966 | Shiver . | |
| 3,491,540 | 1/1970 | Lannemann . | |
| 3,505,821 | 4/1970 | Scisson et al. . | |
| 3,676,078 | 7/1972 | Jacoby . | |
| 3,724,898 | 4/1973 | Jacoby . | |
| 3,864,917 | 2/1975 | Jacoby | 299/5 X |
| 3,950,958 | 4/1976 | Loofbourow | 405/56 X |
| 4,017,120 | 4/1977 | Carlson et al. | 299/5 |
| 4,059,156 | 11/1977 | Berg | 299/6 X |
| 4,232,902 | 11/1980 | Cuevas | 299/4 |
| 4,596,490 | 6/1986 | Van Fossan et al. . | |
| 4,815,790 | 3/1989 | Rosar et al. | 299/5 X |

*Primary Examiner*—Tamara L. Graysay
*Assistant Examiner*—Frederick L. Lagman
*Attorney, Agent, or Firm*—Peter F. Casella

[57] ABSTRACT

A new method for making large underground storage caverns in bedded or domal salt deposits for the storage of fluid materials in areas where solution mining water temperatures are low by a process which significantly reduces the amount of time required to make equivalent sized underground storage caverns and which is economically feasible and friendly to the environment. The process includes the warm water solution mining of the underground salt deposits in a manner which conserves the heat contained in the supernatant brine from the underground cavity and employs this heat as a significant source for warming the water employed in the solution mining operation.

16 Claims, 1 Drawing Sheet

PROCESS FOR MAKING UNDERGROUND STORAGE CAVERNS

BACKGROUND OF THE INVENTION

Figure 1:
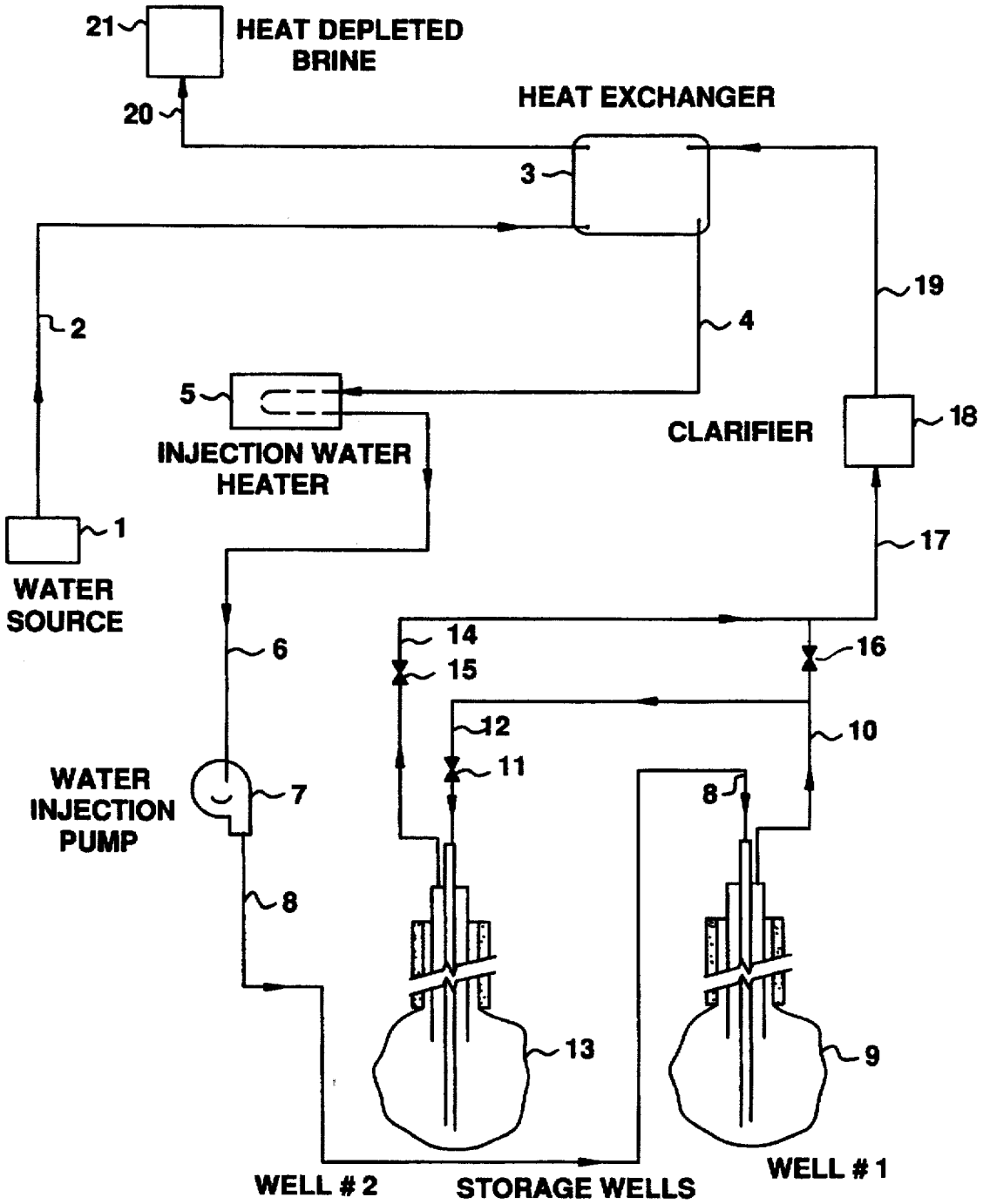

The natural gas, petroleum and petroleum products producing areas located in the Gulf Coast area of the United States produce a major portion of these materials for consumption in all parts of the country. These materials are transported by separate but intricate systems of pipelines that are interconnected for transportation of the gas or petroleum and petroleum products to practically all parts of the country where there is demand for natural gas or petroleum and petroleum products. The demand for natural gas or petroleum and petroleum products for heating and other purposes in the northern part of the Western Hemisphere, i.e. the United States and Canada, during the winter months fluctuates according to how cold it gets. During severe cold spells, blizzards and the like, the demand for natural gas, petroleum and petroleum products often times exceeds the amount the pipeline systems transporting these materials can meet. Accordingly, and in an effort to maintain an even and continuous supply of natural gas, petroleum and petroleum products, it becomes necessary to provide storage space especially for the natural gas, which storage space is generally filled up in off peak demand periods. It is not economical to store large volumes of fluids, such as, gas or petroleum and petroleum products, for extended periods of time in above ground storage tanks. This has prompted the creation and use of underground salt caverns which have been depleted of their salt thereby creating a void space, by solution mining the salt as brine for storage of fluids. Such underground caverns are quite common in the Gulf States where there are abundant supplies of natural gas, petroleum and petroleum products, large deposits of underground salt which can be solution mined to create the caverns for storage of fluids, and a relatively warm salt supply and temperature of salt in the domes. Although there are convenient underground storage caverns which can be economically created for gas, petroleum and petroleum products storage located in the southern part of the United States, the limitations on the capacity, of the gas transmission lines, due to the of size of the installed pipelines, pressure capacity and safety requirements, precludes using the pipelines as a means of transporting the stored gas to the north during the high peak periods of demand that exist during severe cold spells, blizzards and the like. Accordingly, it is desired to provide underground storage caverns having large capacity, for storage of fluids in the northern United States and Canada, so that the storage caverns may be filled up during off peak periods and the stored fluids drawn upon for uninterrupted use during the cold winter peak demand periods, without overloading or disrupting the normal flow of fluid in the transmission pipeline systems.

The solution mining of salt deposits to create caverns for storage of fluids in the warm climates of the United States, such as around the Gulf Coast, can be economically performed because this area does not have the problem of severe cold temperature solution mining that exists in the northern climates and the salt in the domes employed is typically at temperatures above 110 to 120 degrees F. For example, to create a system capable of holding 500 million standard cubic feet of natural gas in the Gulf Coast area, where solution mining water temperatures average about 75–80 degrees F. over the course of a year, a period of about sixteen months of continuous solution mining operations is required. Whereas to create the same sized system using the same techniques in the cooler bedded salt deposits in the northern part of the Western Hemisphere for example in the northeastern part of the United States where there are large underground salt deposits, will require about three to four years of continuous solution mining operations. This extended time period coupled with the attendant high costs it creates, has impeded the creation of large underground fluid storage caverns in bedded salt deposits in the northern part of the Western Hemisphere in areas where there are large underground salt deposits, such as the Great Lakes Areas of the United States and Canada, where the salt deposits may be a mile beneath the ground surface and usually between about 3500 and 4500 feet below the ground..

PRIOR ART

In the early 1950's, the liquefied petroleum gas (LPG) industry, which has gas producing wells primarily in the Gulf Coast area, met the problem of imbalance of supply and demand for propane and butane by developing underground storage chambers in salt deposits via solution mining of the salt deposits in the Gulf States Area. Typical solutions to the LPG storage problem are disclosed in U.S. Pat. No. 2,590,066, issued Mar. 18, 1952 to R. L. Pattinson; U.S. Pat. No. 2,869,328, issued Jan. 20, 1959 to R. M. Gibson, et at; U.S. Pat. No. 3,084,515, issued Apr. 9, 1963 to P. F. Dougherty; and U.S. Pat. No. 3,277,654 issued Oct. 11, 1966 to A. J. Shiver.

Other patents disclose underground storage of materials other than petroleum products such as anhydrous ammonia in U.S. Pat. No. 3,505,821, issued Apr. 14, 1970 to S. E. Scisson et al; radioactive waste liquids in U.S. Pat. No. 3,491,540, issued Jan. 27, 1970 to W. L. Lannemann and assigned to the United States Atomic Energy Commission; chlorine in U.S. Pat. No. 3,724,898 issued Apr. 3, 1973 to C. H. Jacoby and caustic soda in U.S. Pat. No. 4,596,490, issued Jun. 24, 1986 to N. E. Van Fossan et al and assigned to the same assignee as this application.

There are patents directed to the solution mining of underground salt such as U.S. Pat. Nos. 874,906 and 874,907, issued Dec. 24, 1907 to H. Frasch; U.S. Pat. No. 1,923,896, issued Nov. 10, 1931 to E. N. Thump; and U.S. Pat. No. 3,676,078 issued Jul. 11, 1972 to C. H. Jacoby.

None of these patents address the problem of accelerating the formation of underground caverns in cold climates for storage of fluids, such as natural gas, in an economical manner by a process friendly to the environment

OBJECTS OF THE INVENTION

It is an object of this invention to provide a process for making an underground cavern for storage of fluids in domal salt deposits in cold climates which may be a mile under the ground surface and typically about 3500 to 4500 feet below the ground, which is environmentally friendly, economical and less time consuming than making equivalent sized caverns by processes known heretofore. It is a further object to provide a warm water solution mining process of underground salt deposits in a manner which employs the heat contained in the produced brine as a significant source of heat for warming the water employed in the solution mining operation and which reduces the water consumption required for the solution mining. It is still a further object of this invention to provide the timely development of storage caverns within salt deposits concomitant with reduced water consumption and reduced fuel requirements for heating solution mining water to achieve the desired cavern temperature and related salt dissolution rate. It is another object of this invention to provide underground storage caverns having large capacity, for storage of fluids in the northern United States and Canada, so that the storage caverns may be filled up during off peak periods and the stored fluids drawn upon for uninterrupted use during peak demand periods, without overloading or disrupting the normal flow of fluid in the transmission pipeline systems.

DESCRIPTION OF THE INVENTION

The foregoing and other objects are accomplished by the methods and process of this invention which comprises a new method for making large underground storage caverns in salt deposits for the storage of fluid materials by a process which significantly reduces the amount of time required to make equivalent sized underground storage caverns and which is economically feasible and friendly to the environment. The process includes the warm water solution mining of the underground salt deposits in a manner which employs recovery of the heat content of the produced brine salt as a significant source of heat for warming the water employed in the solution mining operation.

The process comprises making an underground cavern for injection and storage of fluid and/or fluidized materials in bedded or domal salt deposits which comprises: employing fresh water from ambient temperature reserves available at or near the salt deposit site; preheating the water by passing it through one side of a heat exchanger, with warm brine on the other side, said warm brine having been produced by solution mining the salt deposit; clarifying the solution mined warm brine to remove sand and other sediments before introduction into the water/brine heat exchanger; further heating the preheated fresh water exiting the heat exchanger by subjecting it to supplemental heating with an appropriate source of heat; injecting the resulting heated water into the salt deposit to cause accelerated dissolution of the salt thus more rapidly forming a cavern in substantially less time than would be required with unheated water; circulating the warm brine exiting the cavern either through a second cavern in series and then to one side of the heat exchanger or directly to the heat exchanger, thereby transferring a significant quantity of its recoverable sensible heat to the fresh water: disposing or otherwise using the heat depleted brine in an environmentally acceptable manner: and, evacuating the brine from the cavern for underground storage of the fluids.

Effects of warmer cavern temperatures on rates of salt dissolution are established art; achieving those effects in an economically feasible process is the essence of this invention. For example, if 50 degree F. water is available to dissolve 86 degree F. salt, doing so with no preheating of the water would produce a cavern temperature of about 75 degrees F. if a brine concentration of 16–17% NaCl is employed. But warming the water to about 137 degrees F. heats the cavern to 120 degrees F. as described earlier. This, at 16–17% salt content, allows operation at two to three times the water throughput rate and thus two to three times the amount of salt dissolved. Therefore, the desired cavern size is achieved in ⅓ to ⅔ the time required at the lower temperature and usually at about ½ of the time required at the lower temperature. This is so because the controlling physical parameters for the rate of salt dissolution, diffusivity and viscosity, are enhanced at higher temperatures. Diffusivity of dissolving salt into the cavity brine increases with temperature and viscosity of that brine decreases with increased temperature. Both effects increase the rate of salt dissolution with the net effect being tripling of the salt dissolution rate in accordance with this invention. It is preferred to operate the solution mining brine at about 16–17% NaCl concentration rather than at or near saturation, which is about 26–27% concentration, because of the effect of concentration difference on rate of dissolution. At higher salt content, concentration difference, rather than diffusivity and viscosity, is the rate controlling parameter.

In the example case, it is desired to produce a cavern capable of storing 500 million standard cubic feet of natural gas while utilizing 500 gallons per minute of fresh water over a sixteen month solutioning period. Direct addition of heat to the water source would require that the water be heated from the temperature at which it is available, in this example case 50 degrees F., to 137 degrees F. With this invention, the brine exiting the well annulus is employed as a heat source for preheating the incoming water prior to addition of heat from an external source. So doing reduces the external heating requirement to 25% of what is required with no heat recovery. The combined effect of shortening cavern formation time and reduced heating cost produces attractive cavern development costs, whereas without heating and heat recovery, unattractive, infeasible costs (and development time) result.

For the example case, solution mining time would be about 40 months with no heating. During that extra time, electric power costs for operating pumping equipment continue to mount. Rather than a cost of about $700,000 power cost alone per well with the shortened schedule, a cost of about $1,750,000 per well results. These figures were calculated with a unit power cost of $0.073 per KWH. In addition, if heat is employed from only an external source with no heat recovery, heating cost is about $800,000 per well rather than about $200,000 per well with fuel costing $3.00 per million Btu. The combined effect produces a substantially lower cost well in an acceptable length of time thus making development of storage caverns in cold climates, where stored gas is truly needed during fuel usage peaks, competitive with developing such caverns in the Southern States of the United States and transporting peak requirements to the north, even assuming the transmission pipeline capacity is available, which as indicated earlier is generally not the case because of the limitations on capacity of the installed pipelines.

THE FIGURES

FIG. 1 is a diagrammatic flow sheet of the process of this invention.

The intended purpose of the example used in the description of FIG. 1 of this invention is development of a cavern(s) in a salt deposit such that the resulting working capacity of each cavern is 500,000,000 standard cubic feet of natural gas. The facility would be connected, via pipeline and employing appropriate compression equipment, to a nearby natural gas transmission pipeline. During periods of reduced natural gas demand from customers, gas is compressed and injected into the storage cavern. When demand exceeds pipeline capacity, such as during severe cold spells, a blizzard or the like in the gas user area, gas flows from the cavern into the pipeline to supplement normal supplies into the pipeline. Sometimes the compressors are reversed to effect this. Thus a means of improving gas supply to the customers is provided.

Construction of such a system involves drilling the well(s) and installing appropriate cemented and hanging strings of pipe (called tubing by the industry) which are capped with a wellhead. Surface pumping and heating facilities are added, and actual processing is started. Power for pumping water and brine is supplied usually by electric motors but sometimes by gas or diesel fired engines or gas turbines.

Referring to FIG. 1:

Fresh water is supplied from wells, river water, or some available, suitable water source (1) and is pumped via pipeline (2) through one side of a heat exchanger (3). The water is heated as it passes through this exchanger by transfer of heat from the warm, clarified dilute brine (19) coming from the well annulus through a suitable clarifier (18) which removes sand and entrained solids. This warm brine then exchanges heat to the cool water. For the example case, conventional counter current plate and frame heat exchange equipment (3) is employed to allow a 5 to 10 degree F., approach of the warmed water temperature (4) to the incoming brine temperature (19). Water so warmed then passes through pipeline (4) to a heater (5) which uses an external source of heat, such as a gas fired water heater utilized for the example case. The heated water @135–137 degrees F. (6) then enters a suitable high head injection pump (7) for injection into the salt cavity (9) via the center well tubing (8). As the water flows down the tubing in transit to the cavity where it dissolves salt, cavity brine formed by that dissolution flows up the annulus surrounding the water tubing to the surface (10), through valve 16 and line 17 on to where it is clarified (18) to remove entrained sand and other solids. Valves 11 and 12 are closed for this descriptive single well, single borehole case. This brine enters that annulus inside the cavern (9) at 120 degrees F. and is warmed as it travels to the surface by exchange of heat with incoming heated water (8). The heat transfer dynamics are such that brine exits the wellhead (10) at 5 to 10 degrees F. cooler than the incoming water and water exits the end of the injection tubing at 5 to 10 degrees F. warmer than the cavern temperature. This excess of sensible heat in the entering water overcomes the heat losses associated with operating the cavern to hold the cavern temperature constant at the desired 120 degrees F. Such heat effects are the negative latent heat of solution, sensible heat transferred to the dissolving cooler salt, and heat losses to the cavern walls and well borehole by convection. These were described elsewhere.

The description presented is for a single cavity with one borehole, but variations include single cavity, multiple borehole systems, in which case only a single injection or removal string of tubing is employed, and the transfer of heat between in flowing water and exiting brine is avoided. Description of this is excluded for clarity. Another variation is the placement of single cavity, single borehole wells in series as depicted with the second well (13) in FIG. 1. Here valves 11 and 15 are opened and valve 16 is closed. This technique further shortens development time by utilizing partially saturated warm brine from the first well (12) to solution mine salt from a second well connected in series. The warm, stronger brine (14) emerging from that second well is then clarified and utilized to preheat the fresh water supply.

In any system, heat depleted brine is disposed of by injection into disposal wells, use in chemical plants requiring brine, or some other environmentally appropriate manner.

There are various heat effects that are encountered in the process of this invention for the accelerated formation of storage caverns in bedded or domal salt deposits.

The first heat effect is cooling of the cavern brine caused by the latent heat of solution of the salt at the concentration employed, which in the example is about 14 BTU's per pound of salt that is dissolved.

The second heat effect is the actual sensible heat that the dissolving salt brings to the solution or takes away from the solution. In general in the colder climates and at normal depths of the salt deposit, which in the example is about 3900 feet below the surface, the salt is warmed and the cavern brine is cooled because, when the salt from the cavern wells is dissolved into the brine, it cools the brine by the amount of sensible heat that is required to heat the salt up to the brine temperature. Sensible heat from the injected water is retained in the brine in the cavern because the rate of heat transfer to or from the cavern salt walls by convection is small and the rate to or from the bore hole where water and brine tubing is installed from the surface is negligible.

The third effect is the transfer of heat between the cavern brine and the salt deposit itself by convention through the wells. The heat transfer coefficient is estimated at between 0.02 and 0.03 Btu/hr/sqft/°F. In the case of dissolving cooler salt with warmer cavern brine, the heat is transferred from the brine to the salt deposit through the cavern walls, so that some heat is lost.

These three heat effects naturally occur in any type cavern. As depicted in FIG. 1, numbers 9 and 13, where one borehole protrudes into the cavern and the water is pumped into the concentric robing hanging down into the cavern while the brine is removed through the annulus between that tubing and another hanging string of pipe through the cemented borehole casing, as the brine comes up out of the cavern in the annulus it transfers heat to or accepts heat from the water coming in. In the case where the water coming into the cavern is preheated, the brine coming out of the cavern is warmed to within several degrees of that water temperature, generally 5 to 10 degrees F. The water temperature entering the actual cavern is limited by the heat transfer efficiency of the heat exchanger formed by the two hanging strings of tubing. A second annular space is formed between the cemented casing and the larger diameter hanging tubing. Heat transfer through this space is negligible because it is filled with nitrogen or other suitable pad gas or stagnant organic liquid thus allowing little heat convection while in operation.

All of these effects combined result in a heat balance around the cavern which is used to predict the temperature to which the water has to be heated in order to yield the desired cavern temperature. For example, in the case of using a salt temperature of 86 degrees F. and a desired cavern temperature of 120 degrees F. the water is heated to 135 to 137 degrees F. to achieve the 120 degrees F. cavern temperature. The 120 degrees F. is the temperature at which the brine enters the annulus of the heat exchanger in the cavern. It is transferring heat with water that is entering at 137 degrees F. and this water will cool to about 127 degrees F. In essence about 7 degrees F. of water sensible heat is employed to overcome the heat loss effects in the cavern.

Cavern temperatures above 120 degrees F. may be employed and will produce more accelerated solution of the domal salt deposits: however we prefer to operate at the cavern brine temperature at about 120 degrees F. for the circumstances and conditions depicted in the case example as explained above. Cavern temperatures ranging between about 105 and 145 degrees F. may be employed depending in part on the temperature of the water available at the site and the amount of preheating employed. The preheating water temperatures that may be employed may be between about 85 and 140 degrees F. exiting the heat exchanger. In the foregoing description of the case example, the solution mined warm brine is at a temperature of between about 110 to 115 degrees F. and this temperature may vary to between about 95 to 150 degrees F. depending on the other operating temperature parameters employed. Further, the preheated fresh water exiting the injection water heat exchanger is given as about 135–137 degrees F. in the foregoing description of the of the case example. This temperature may be between about 105–160 degrees F. depending upon the amount of supplemental heating employed. Also, employing an insulating layer of paint, plastic material or other suitable insulating material on the inner, outer or both surfaces of the injection tubing limits the heat transfer rate between injection water and evolving brine and increases cavern temperature. By operating in accordance with our invention, the rate of salt dissolution may be accelerated two to four fold of that required without employing the heat recovery techniques of this invention. The external heat requirement was reduced to 25% of that which would have been required without employing the heat recovery techniques of this invention. This is a 75% reduction as given in the example case and, depending on the operating parameters employed, the reduction in external heat requirement may be between about 60 to 80%.

In the foregoing description of our invention, we have exemplified the storage of natural gas in the caverns produced in accordance with our invention. Other materials such as petroleum and petroleum products may of course be stored in the caverns, especially because no special methods or techniques need be employed when storing these materials. Other materials including chemicals such as ammonia, chlorine, caustic soda, radio active materials, among others may be stored in the caverns even though they may require additional processing techniques and often times require specialized construction of the caverns for storage of hazardous materials.

Although we have exemplified making a single stand alone cavern having a capacity of 500 million standard cubic feet, single caverns having capacities of 0.2 to 3.5 billion standard cubic feet are embraced within the preferred scope of our invention, and as technology and geologic exploration progresses is envisioned that the teachings of our invention may be employed to make still larger capacity caverns. Under present circumstances, and in accordance with our invention, if larger storage capacity, is desired, multiple caverns can be made in the location, and these may be connected in series as depicted in the Figure to optimize solution mining time commensurate with required storage space.

Among the preferred uses for the brine resulting from our process for making underground storage caverns is to make solid salt in a salt evaporation plant installation. This use of the brine is especially attractive in the cold northern climates where solid salt is employed for snow and ice control on roads and highways. Further, since electrochemical industries have built up in areas where salt is available, the solid salt may be shipped to the electrochemical plant installations, or the brine resulting from our process may be transported by pipeline or other means to the electrochemical plants for decomposition to chlorine, caustic soda and hydrogen.

Although our invention is described using specific examples and embodiments thereof to facilitate its understanding, it should be understood that many modifications and variations of the invention described may be made without departing from the spirit and scope thereof.

We claim:

1. A process for making an underground cavern for injection and storage of fluid or fluidized materials in bedded or domal salt deposits which comprises:

employing fresh water from ambient temperature reserves available at or near the salt deposit site, preheating the water by passing it through one side of a heat exchanger, with water on one side and warm brine on the other side, said warm brine having been produced by solution mining the salt deposit, clarifying the solution mined warm brine to remove sand and other sediments before introduction into the heat exchanger, further heating the preheated fresh water exiting the heat exchanger by subjecting it to supplemental heating with an appropriate source of heat, injecting the resulting heated water into the salt deposit to cause accelerated dissolution of the salt thus more rapidly forming a cavern in substantially less time than would be required with unheated water, circulating the warm brine exiting the cavern either through a second cavern in series and then to one side of the heat exchanger or directly to the heat exchanger, thereby transferring its sensible heat to the fresh water, disposing or otherwise using the heat depleted brine in an environmentally acceptable manner, and evacuating the brine from the cavern for underground storage of the fluids.

2. The process according to claim 1 wherein the fluid is natural gas.

3. The process according to claim 1 wherein the fluid is crude petroleum or petroleum products.

4. The process according to claim 1 wherein a cavern having a capacity of about 0.2 to 3.5 billion standard cubic feet is prepared.

5. The process according to claim 1 including the step of employing the brine produced in an electrolytic decomposition to produce chlorine, caustic soda and hydrogen.

6. The process according to claim 1 including the step of employing the brine produced to make solid salt in an evaporation plant.

7. The process according to claim 1 including the step of employing the brine produced by injecting it into into disposal wells.

8. The process according to claim 1 including the step of forming two separate caverns connected in series.

9. The process according to claim 1 including the step of using the warm brine from the first cavern to solution mine salt from the second cavern.

10. The process according to claim 1 including the step of preheating the fresh solution mining water by cross exchanging with warm brine to a temperature of between about 85–140 degrees F.

11. The process according to claim 1, including the step of employing external heat to increase the solution mining water injected into the cavern to a temperature of between about 105–160 degrees F.

12. The process according to claim 1 including the step of maintaining the temperature in the cavern during solution mining at about 105–145 degrees F.

13. The process according to claim 1 wherein the external heat requirement to maintain the desired cavern temperature is reduced by about 60–80% employing heat recovery of this invention.

14. The process according to claim 1 wherein the rate of salt dissolution is accelerated two to four fold.

15. A process for making an underground cavern for injection and storage of natural gas in underground salt deposits which comprises:

employing fresh water from ambient temperature reserves available at or near the salt deposit site, preheating the water to a temperature of between about 85–140 degrees F. by passing it through one side of a heat exchanger, with water on one side and warm brine on the other side, said warm brine having been produced by solution mining the salt deposit, employing an insulating layer of paint, plastic material or other suitable insulating material on the inner, outer or both surfaces of the injection tubing to limit the heat transfer rate between injection water and evolving brine and to increase cavern temperature, clarifying the solution mined warm brine which is at a temperature of between about 95–150 degrees F. to remove sand and other sediments before introduction into the heat exchanger, further heating the preheated fresh water exiting the water/brine heat exchanger to a temperature of between about 105–160 degrees F. by subjecting it to supplemental heating with an appropriate source of heat, injecting the resulting heated water into the salt deposit to cause a three fold accelerated dissolution of the salt thus more rapidly forming a cavern in substantially less time than would be required with unheated water, circulating the warm brine exiting the cavern either through a second cavern in series and then to one side of the heat exchanger or directly to the heat exchanger, thereby transferring its sensible heat to the fresh water, disposing or otherwise using the heat depleted brine in an environmentally acceptable manner, and evacuating the brine from the cavern for underground storage of natural gas.

16. A process for making an underground cavern for injection and storage of fluid or fluidized materials in bedded or domal salt deposits which comprises:

employing fresh water from ambient temperature reserves available at or near the salt deposit site, preheating the water by passing it through one side of a heat exchanger, with water on one side and warm brine on the other side, said warm brine having been produced by solution mining the salt deposit, clarifying the solution mined warm brine to remove sand and other sediments before introduction into the heat exchanger, further heating the preheated fresh water exiting the heat exchanger by subjecting it to supplemental heating with an appropriate source of heat, injecting the resulting heated water into the salt deposit to cause accelerated dissolution of the salt thus more rapidly forming a cavern in substantially less time than would be required with unheated water, employing an insulating layer of paint, plastic material or other suitable insulating material on the inner, outer or both surfaces of the injection tubing to limit the heat transfer rate between injection water and evolving brine and to increase cavern temperature, and circulating the warm brine exiting the cavern either through a second cavern in series and then to one side of the heat exchanger or directly to the heat exchanger, thereby transferring its sensible heat to the fresh water.

* * * * *